US012239238B1

(12) United States Patent
Chen et al.

(10) Patent No.: US 12,239,238 B1
(45) Date of Patent: Mar. 4, 2025

(54) CUSHION

(71) Applicants: Guojun Chen, Taizhou (CN); Wei Wei, Hangzhou (CN)

(72) Inventors: Guojun Chen, Taizhou (CN); Wei Wei, Hangzhou (CN)

( * ) Notice: Subject to any disclaimer, the term of this patent is extended or adjusted under 35 U.S.C. 154(b) by 57 days.

(21) Appl. No.: 18/437,002

(22) Filed: Feb. 8, 2024

(30) Foreign Application Priority Data

Jan. 31, 2024 (CN) ..... 202410131752.5

(51) Int. Cl.
*A47C 7/02* (2006.01)
*A47C 7/72* (2006.01)
*A47C 27/14* (2006.01)

(52) U.S. Cl.
CPC ..... *A47C 7/021* (2013.01); *A47C 7/727* (2018.08); *A47C 27/14* (2013.01)

(58) Field of Classification Search
CPC ..... A47C 7/021; A47C 7/727; A47C 27/14; A47G 9/10; A47G 9/1036; A47G 9/1045
See application file for complete search history.

(56) References Cited

U.S. PATENT DOCUMENTS 3,290,450 A * 12/1966 Majoros ..... H04R 5/023 5/639
6,408,468 B1 * 6/2002 Comfort ..... A47G 9/10 5/639
10,201,240 B1 * 2/2019 Arrighi ..... A47G 9/1054
2005/0173965 A1 * 8/2005 Shaikh ..... A47C 7/021 297/452.21
2007/0124862 A1 * 6/2007 Beyda ..... H04R 5/023 5/639
2007/0253591 A1 * 11/2007 Popilek ..... A61M 21/00 381/301
2009/0021386 A1 * 1/2009 Liao ..... A47C 7/723 340/667
2010/0275378 A1 * 11/2010 Xiao ..... A47G 9/1045 5/639
2010/0295339 A1 * 11/2010 Siu ..... B60N 2/5635 297/180.14
2012/0131747 A1 * 5/2012 Sclare ..... A61F 7/02 362/127
2013/0079584 A1 * 3/2013 Armbruster ..... H04R 25/75 600/28
2016/0055842 A1 * 2/2016 DeFranks ..... G10K 11/175 381/66
2016/0066716 A1 * 3/2016 Rao ..... A61B 5/6814 600/26
2017/0143254 A1 * 5/2017 Bell ..... A61B 5/4815
2018/0317677 A1 * 11/2018 Genao ..... A47G 9/1045
(Continued)

*Primary Examiner* — George Sun

(57) ABSTRACT

A cushion is provided, which relates to the technical field of home and outdoor patio leisure products, including a cover, a soft core, a power supply unit, a sounder, and a luminescent strip; the cover wraps around the soft core, the sounder is arranged in the soft core, and the luminescent strip is arranged inside the margin edge strip and/or a decorative edge of the side of the cover and powered by the power supply unit. The cushion has the function of helping soothing, relaxing, sleep and regulating the atmosphere, and has the characteristic of easy finding and positioning. The combination of the sounder and the luminescent strip not only enriches the functions of the cushion, but also improves the convenience of use.

8 Claims, 11 Drawing Sheets

(56) References Cited

U.S. PATENT DOCUMENTS

| | | | | |
|---|---|---|---|---|
| 2019/0082867 | A1* | 3/2019 | Huang | A47G 9/1036 |
| 2019/0307270 | A1* | 10/2019 | Blum | A47G 9/1036 |
| 2019/0350389 | A1* | 11/2019 | Sutton, Jr. | A63H 3/005 |
| 2021/0186235 | A1* | 6/2021 | Zamora | A47G 9/10 |
| 2022/0175162 | A1* | 6/2022 | Hung | A47G 9/1009 |
| 2023/0000269 | A1* | 1/2023 | Waring | A61M 16/1005 |
| 2023/0118357 | A1* | 4/2023 | Milne | A47G 9/1045 5/639 |

* cited by examiner

CUSHION

CROSS-REFERENCE

This application claims to the benefit of priority from Chinese Application No. 202410131752.5 with a filing date of Jan. 31, 2024. The content of the aforementioned applications, including any intervening amendments thereto, are incorporated herein by reference.

TECHNICAL FIELD

The disclosure relates to the technical field of home and outdoor patio leisure products, in particular to a cushion.

BACKGROUND

Cushions are commonly used items in home and daily life, mainly including pillow cushions and seat cushions. The filling material of the pillow cushion is relatively fluffy and soft, with headrest and throw pillows, while the filling material of the seat cushion is relatively firm. With the improvement of life quality, the application of cushions is becoming more and more diverse. In addition to being commonly used for leaning and sitting, they are also used as decorations, toys, etc., playing a more important role in regulating the living atmosphere.

The existing technology often only changes the shape of the cushion, designing a cushion in the shape of a small animal, giving people a warm feeling. However, with the increasing variety of cushion application scenarios, these changes can no longer meet usage needs of people. For example, the cushions in existing technology do not have the functions of helping soothing, relaxing and sleeping. When used in dim light environments, the cushions in existing technology also cannot serve the purpose of regulating the atmosphere and facilitating the search for positioning.

SUMMARY

In view of the above-described disadvantages of the prior art, it is the purpose of the disclosure to provide a cushion for solving the problem that the cushion of the prior art is not able to help on soothing, relaxing and sleep, and cannot serve the purpose of regulating the atmosphere and facilitating the search for positioning in dim scenes.

To achieve the above and other related purposes, the disclosure provides a cushion, including:

a cover, a soft core, a power supply unit, a sounder, and a luminescent strip,

Wherein the cover wraps the soft core, the sounder is arranged in the soft core, and the luminescent strip is arranged inside a margin edge strip and/or a decorative edge of a side of the cover and powered by the power supply unit.

Optionally, the soft core is folded and sewn to form an inner bag in a shape of a pocket, and the sounder is capable of being taken out or placed in the inner bag in a fixed manner.

Optionally, the sounder is configured to play white noise, and powered by the power supply unit and/or a built-in battery, the sounder is capable of playing preset content and/or controlling play content through Bluetooth.

Optionally, the cover is made by sewing fabric, the margin edge strip on the side of the cover is form by sewing a margin zone that left after the fabric is folded in half together, and the luminescent strip is threaded inside the margin zone.

Optionally, the decorative edge is a fabric bag strip made of fabric, the luminescent strip is threaded into the fabric bag strip, and the fabric bag strip is fixedly sewn on the side of the cover or detachably connected to the side of the cover.

Optionally, the cushion further includes a heating sheet and/or a cooling sheet arranged between the cover and the soft core; and the upper and lower sides of the cushion are provided with the cooling sheet or the heating sheet respectively, or one side is provided with the heating sheet and the other side is provided with the cooling sheet.

Optionally, the power supply unit is a power bank or a battery box removably placed in the inner bag; and/or, the power supply unit is a power supply interface arranged on the cover.

Optionally, the cushion further includes an inner frame, wherein the inner frame is placed in the soft core of the cushion, the interior of the inner frame is provided with a cavity, the cavity is provided with a sounder, the cavity is provided with sound holes on the side facing a leaning surface of the cushion, the bottoms of the sound holes penetrate into the cavity of the inner frame, the sound direction of the sounder is perpendicular to the directions of the sound holes, and the sound of the sounder is vertically emitted from the sound holes after multiple lateral reflections on a side wall of the cavity.

Optionally, the top surface of the inner frame is provided with a plurality of annular grooves, and the sound holes are arranged inside the annular grooves;

The top surface of the inner frame is further provided with at least two straight grooves arranged in "X" shape, and the plurality of the annular grooves are divided into at least four areas by the straight grooves, each area is an independent broadcasting zone;

The cavity of the inner frame is provided with partition plates that match positions of the straight grooves, the partition plates divide the cavity into broadcasting chambers that match the broadcasting zones, and the sounder is positioned in the middle of the four broadcasting chambers and plays sound to the four broadcasting chambers.

Optionally, resilient hollowed members are fixedly arranged in the annular grooves and filled with fluid; in the initial state, the cross-sections of the resilient hollowed members are smaller than that of the annular grooves, and the sound holes in the annular grooves are directly communicated with the outside; when a part of resilient hollowed members are compressed, the remaining part of resilient hollowed members expand and tightly fit with the annular grooves to block the corresponding sound holes.

As described above, a cushion of the disclosure has at least the following advantages:

The cushion can help soothing, relaxing, sleeping and regulating, and regulate the atmosphere in dim light environments. It also has the characteristic of easy finding and positioning. Specifically, the cushion includes a cover, a soft core, a power supply unit, a sounder, and a luminescent strip. The sounder is arranged in the soft core and can play various soothing music, such as natural white noise. When people's head is leaning on the cushion, they can immerse themselves in the soothing music and become relaxed; a luminescent strip is arranged around the side of the cushion, which can liven up the atmosphere. For example, enhancing the atmosphere and aesthetics of festivals, birthdays, and parties, and also soothe children emotions when crying, or serve as emergency lighting. The luminous function can enhance the atmosphere, decoration, or serve as outdoor emergency lighting in outdoor parties, gardens, camping, outdoor coffee, and other scenes. It also facilitates the positioning of the cushion, making it easy to find in dim light environments. Overall, the combination of the sounder and the luminescent strip not only enriches the functions of the cushion, but also improves the convenience of use.

Figure 1:
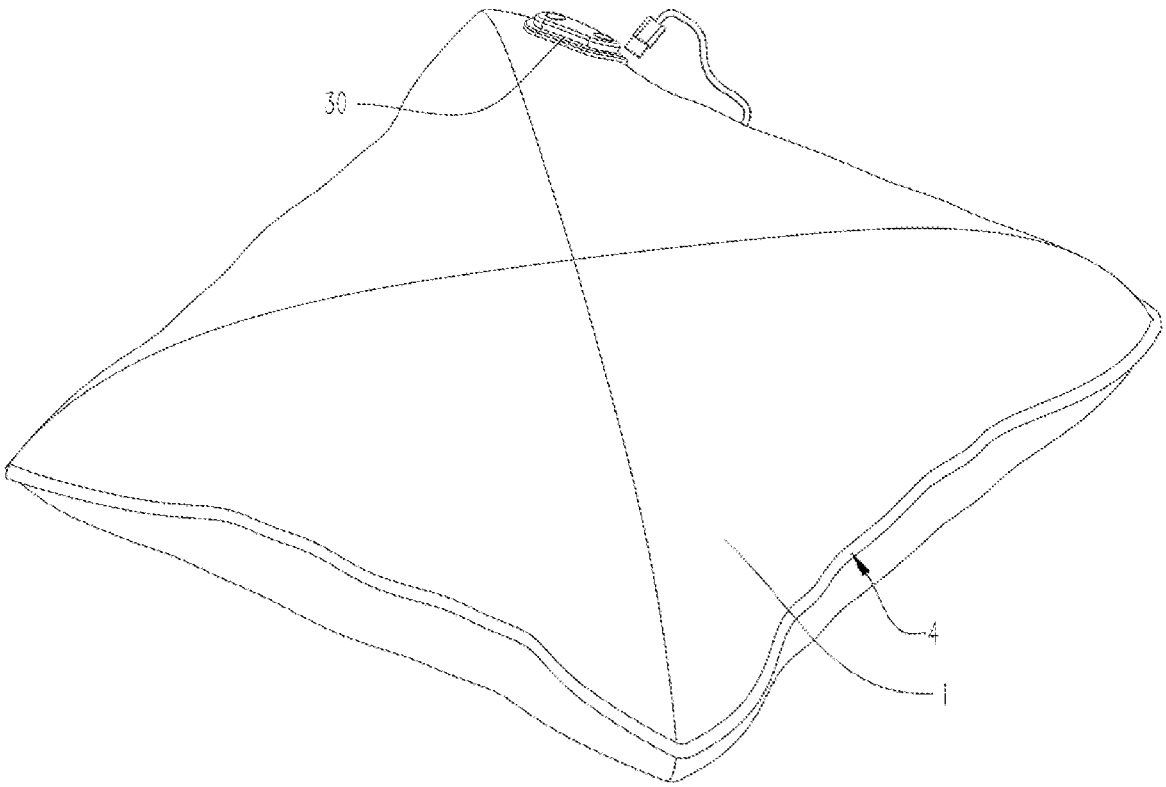
FIG. 1 is a schematic diagram of the appearance of the cushion of the disclosure.

Reference numbers in the drawings: 1—cover, 10—margin zone, 11—fabric bag strip, 2—soft core, 20—inner bag, 30—power supply interface, 4—luminescent strip, 5—sounder, 6—heating sheet, 7—inner frame, 70—annular groove, 701—soundhole, 71—straight groove, 72—broadcasting zone, 73—partition plate, 74—broadcasting chamber, 75—pull-out plate, 76—temperature control medium, 8—resilient hollowed member, 80—electrode, and 9—luminous band.

DETAILED DESCRIPTION OF THE EMBODIMENTS

The following embodiments of the disclosure are illustrated by specific embodiments, and those familiar with the art can readily appreciate other advantages and effects of the disclosure from what is disclosed in the specification.

Please refer to FIGS. 1 to 11, it should be noted that the structures, proportions, sizes, etc. depicted in the accompanying drawings of the specification are only intended to complement the content disclosed in the specification for those familiar with the technology to understand and read, and are not intended to limit the implement conditions of the disclosure. Therefore, they do not have any technical substantive significance. Any modifications to the structure, changes in the proportion relationship, or adjustments in size should still fall within the scope of the technical content disclosed in the disclosure, without affecting the efficacy and goals that can be achieved. Meanwhile, the terms such as "up", "down", "left", "right", "middle", and "one" cited in the specification are only for the sake of clarity and are not intended to limit the scope of implementation of the disclosure. Any changes or adjustments in their relative relationships, without substantial changes in technical content, shall also be considered as the implementable scope of the disclosure.

The following embodiments are for illustrative purposes only. Various embodiments can be combined, which is not limited to the content presented in the following individual embodiments.

Figure 2:
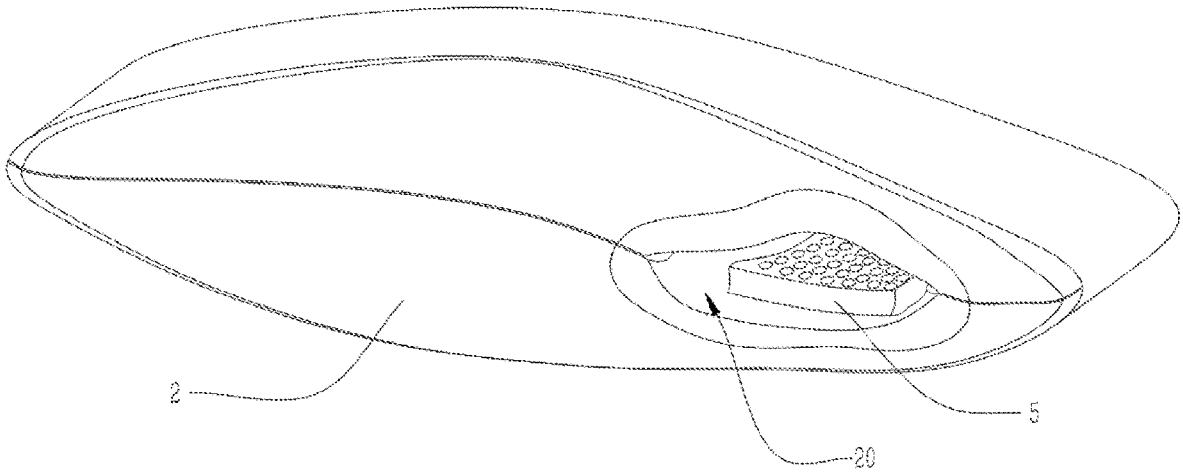
FIG. 2 is a schematic diagram of the soft core of the cushion of the disclosure.
Figure 3:
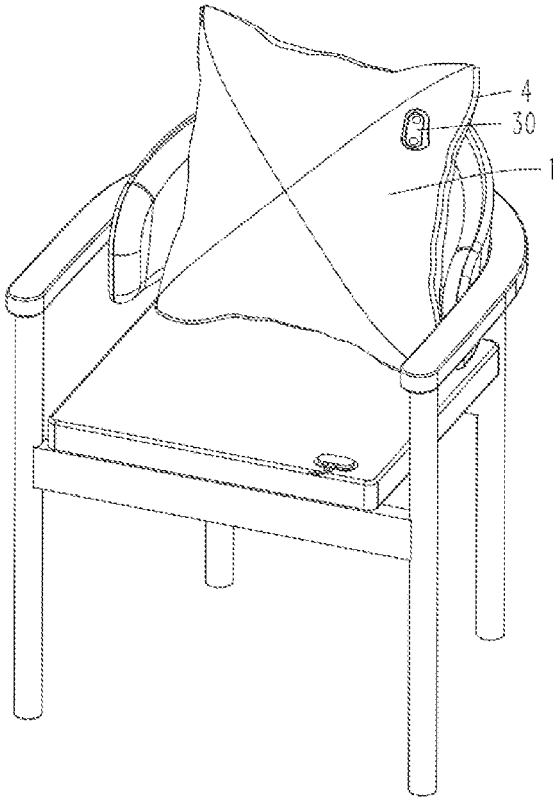
FIG. 3 is a schematic diagram of placing the pillow and cushion of the disclosure in the chair.
Figure 6:
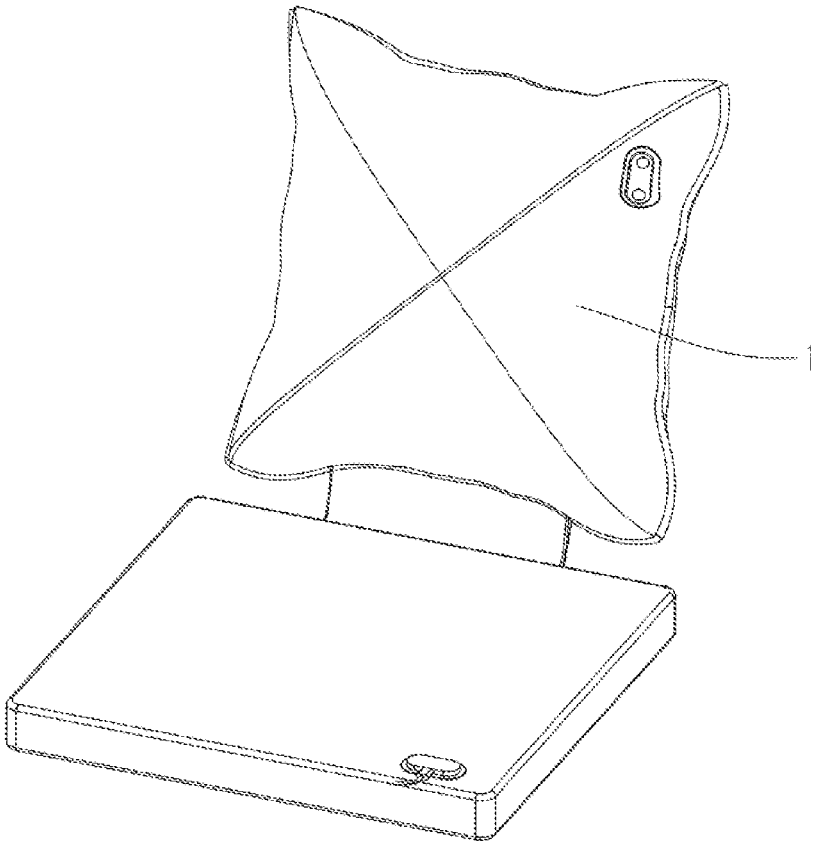
FIG. 6 is a schematic diagram of the flexible combination use of the pillow and the cushion of the disclosure.

Please refer to FIGS. 1 and 2 for this embodiment. An embodiment of a cushion provided by the disclosure includes: a cover 1, a soft core 2, a power supply unit, a sounder 5, and a luminescent strip 4. The cover 1 wraps around the soft core 2, the sounder 5 is arranged in the soft core 2, and the luminescent strip 4 is arranged inside the margin edge strip and/or the decorative edge on the side of the cover 1 and powered by the power supply unit. The luminescent strip can be a self-luminous light strip or an optical fiber. When an optical fiber is used, a light source may be provided on one or both sides of the optical fiber. In specific implementation, different soft cores 2 can be used according to the different uses of the cushion, which is achieved by changing the filling of the soft core 2. For example, as shown in FIGS. 3 and 6, when used as a throw pillow or headrest, it is generally filled with fluffy fiber; when used as a cushion for seating, it is filling with more dense. Alternatively, as shown in FIG. 6, the pillow and the cushion can be connected through flexible fabric, or they can be placed on a chair for use as shown in FIG. 3. In specific implementation, common filling materials include PP fiber, non-glue fiber, polyester fiber, foam, bean, cotton, down, etc., which can be selected according to different fluffiness requirements. The sounder 5 is arranged in the soft core 2, which not only avoids protruding from the surface of the cushion and causing discomfort to the user, but also prevents external forces from pressing on the sounder 5 and causing damage. After the sounder 5 is arranged in the soft core 2, it can be turned on during use. For example, when used as a headrest, it can play white noise that simulates the natural environment or specialized lullabies to help users soothe their minds and bodies through sounder 5, such as gentle breeze by the ear and the birdsong in the distance, leaning against the headrest and closing eyes, as if being in the natural environment, that can soothe the various pressures of user from fast-paced work and life, as well as the long and short-term travel fatigue and negative emotions, to assist in playing a certain healing effect. Due to the sounder 5 is arranged in the pillow, only a very faint sound is needed for the user to hear, which can avoid wearing headphones and the impact of traditional external sounder modes on others around them. But if necessary, the white noise player can also be taken out and used separately. At the same time, a luminescent strip 4 is arranged around the side of the cushion, which can liven up the atmosphere. For example, increasing the atmosphere and aesthetics of festivals, birthdays, and parties, can also soothe children emotions when crying and serve as emergency lighting. The luminous function can enhance the atmosphere, decoration, or serve as outdoor emergency lighting in outdoor parties, gardens, camping, outdoor coffee, and other scenes. It also facilitates the positioning of the cushion, making it easy to find in dim light environment.

As shown in FIG. 2, the soft core 2 is folded and sewn to form an inner bag 20 in a shape of a pocket, and the sounder 5 can be removed or fixed in the inner bag 20. The production method of the inner bag 20 is simple and convenient, which can ensure that the sounder 5 is separated from the filling in the soft core 2, so that the sounder 5 is always positioned in the middle area of the soft core 2, preventing the position of the sounder 5 in the soft core 2 from changing, for example, if the position of the sounder changes to one side, it may protruding from the surface of the cushion and causing discomfort to the user, or cause itself to be crushed. The sounder 5 serves as an independent player, and the inner bag 20 also facilitates the removal and re-insertion of the sounder 5. Once the sounder 5 is removed, it can also be used as an external player for normal use.

Furthermore, the sounder 5 is used for playing white noise, and powered by a power supply unit and/or a built-in battery. The sounder 5 can play preset content and/or control playback through Bluetooth. The sounder 5 can store music, which can be taken out and pre-stored the play content before being placed back in the soft core 2, and the sounder 5 will automatically play the pre-stored content. The sounder 5 also has Bluetooth function, the sounder can be controlled by such as mobile phone after pairing with devices to change the play content and adjust the sound level, without removing the sounder from the soft core again, which can dramatically increase the sense of experience and convenience.

Figure 4:
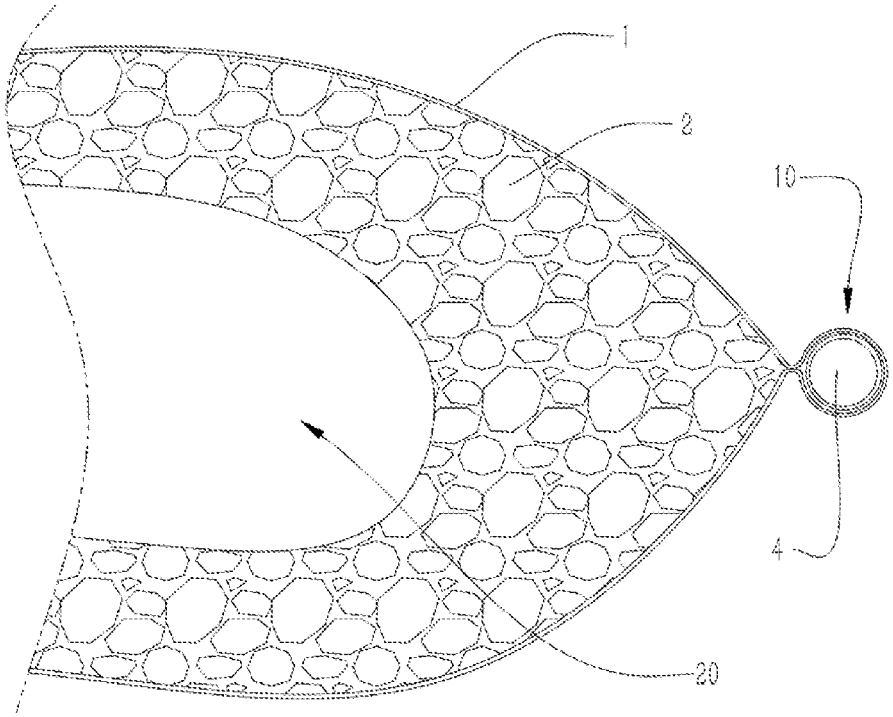
FIG. 4 is a cross-sectional schematic diagram of the margin zone mode of the disclosure.

The embodiment can be referred to FIG. 4, the cover 1 is made by sewing fabric, the margin edge strip on the side of the cover 1 is form by sewing a margin zone 10 that left after the fabric is folded in half together, and the luminescent strip 4 is threaded inside the margin zone 10. The method is relatively simple to implement, after folding the fabric in half, which is used as a cover, leave an appropriate margin at the folded area, and then sew it to form a margin zone 10. Then, the luminescent strip is threaded into the margin zone 10, such that the luminescent strip 4 is hidden inside the margin zone 10. In this way, the existence of the luminescent strip cannot be seen from the appearance of the cushion. When the luminescent strip is energized, light can pass through the fabric, forming a circle of light bands around the cushion, it can indicate the contour of the cushion and has a strong visual sense.

Figure 5:
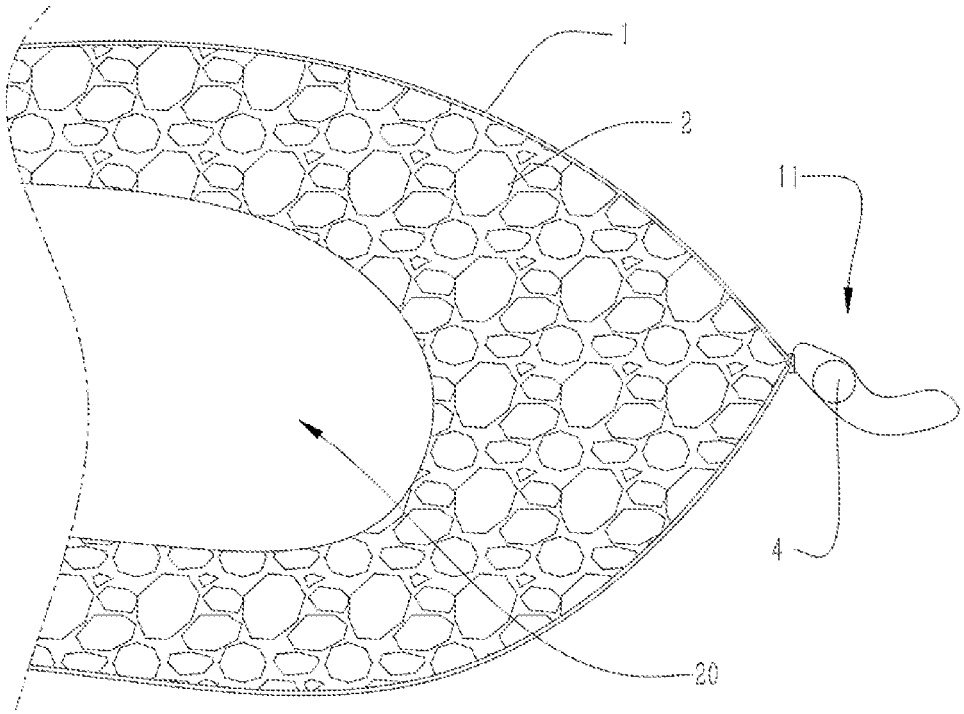
FIG. 5 is a cross-sectional schematic diagram of the fabric bag strip mode of the disclosure.

Please refer to FIG. 5 for the embodiment, the decorative edge is a fabric bag strip 11 made of fabric, the luminescent strip 4 is threaded into the fabric bag strip 11, and the fabric bag strip 11 is fixedly sewn on the side of the cover 1 and/or detachably connected to the side of the cover 1. Fold and sew the long edges of the striped fabric to form a tube shape, then thread the luminescent strip 4 inside the tube shape, and seal both ends to obtain a fabric bag strip 11. A plurality of fastener can be arranged on the fabric bag strip 11 at intervals, and a plurality of fastener can also be arranged on the circumference of the cushion at intervals, so that the fabric bag strip 11 can be detachably fixed to the cushion, increasing the aesthetics of the cushion. It can also be replaced with fabric bag strips 11 of different colors and lace according to different scenarios, enhancing the applicability of the cushion.

Figure 7:
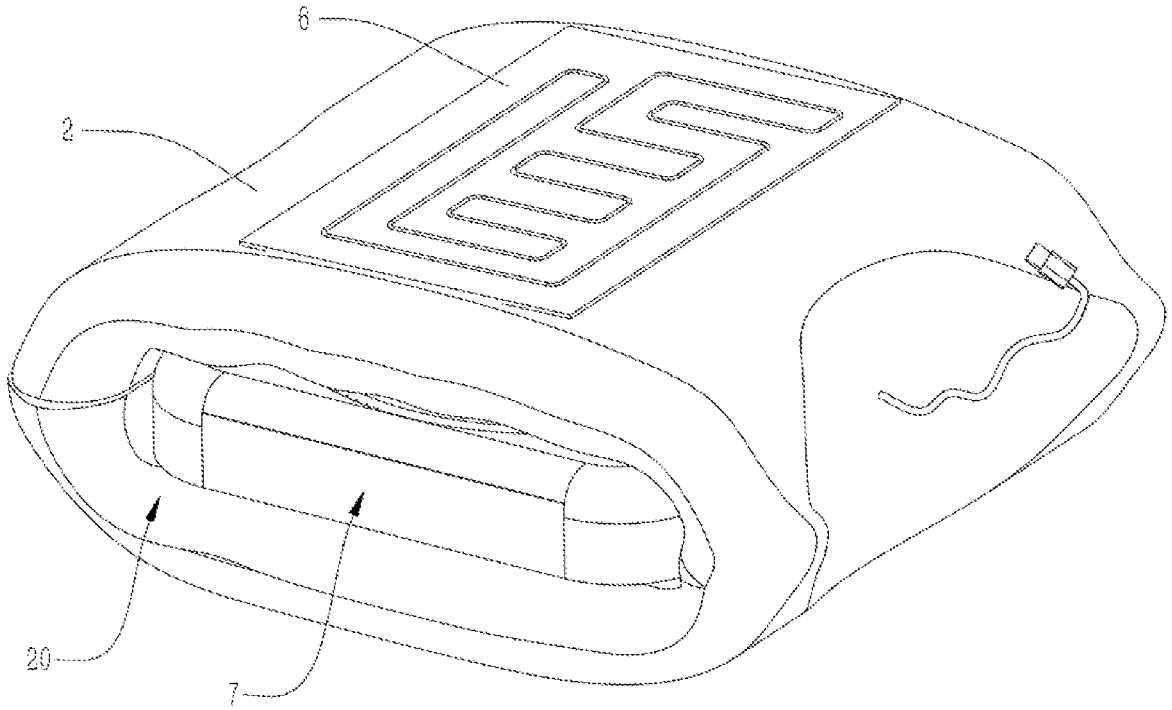
FIG. 7 is a schematic diagram of the soft core and the inner frame of the disclosure.
Figure 8:
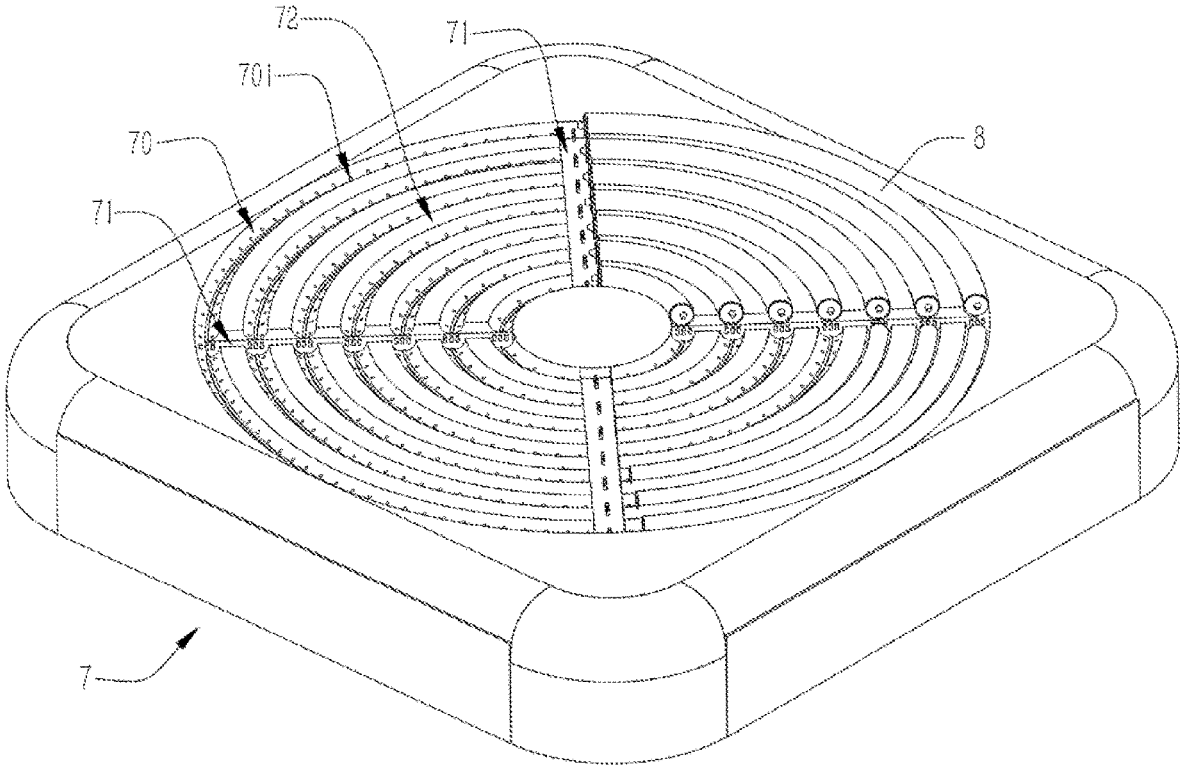
FIG. 8 is a schematic diagram of the inner frame of the disclosure.
Figure 9:
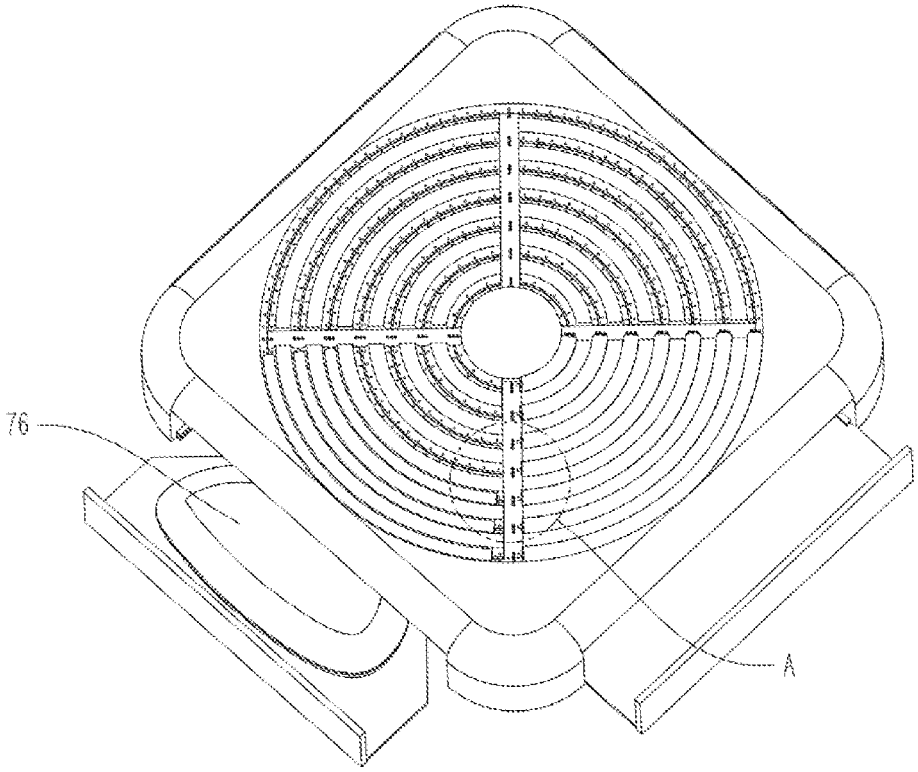
FIG. 9 is another schematic diagram of the inner frame of the disclosure.
Figure 10:
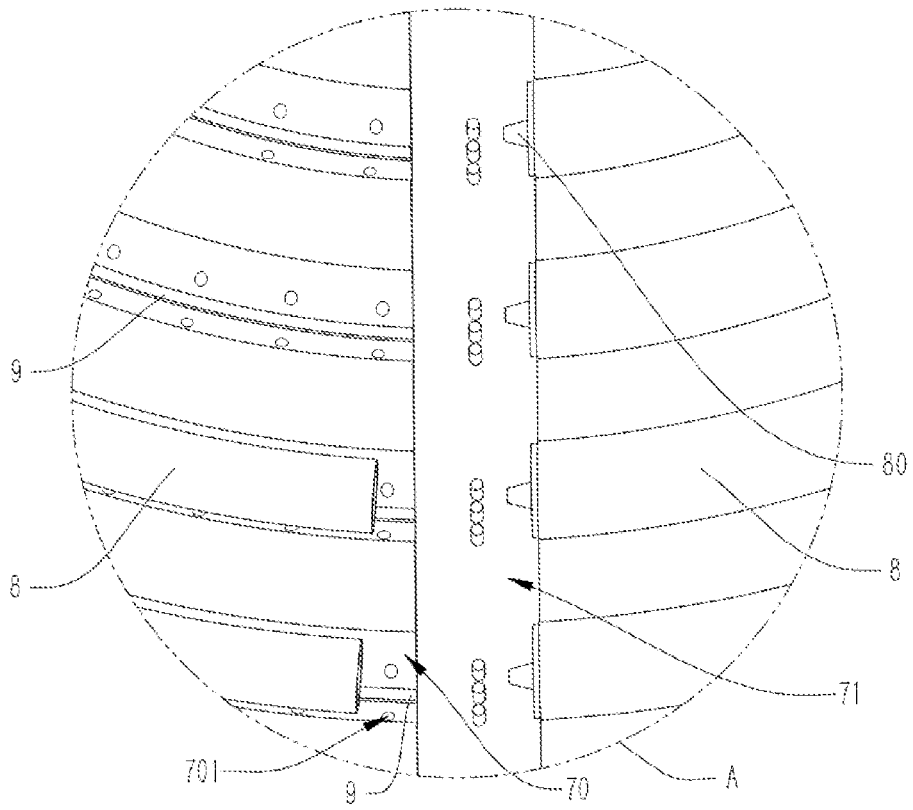
FIG. 10 is an enlarged partial schematic diagram at position A in FIG. 9 of the disclosure.
Figure 11:
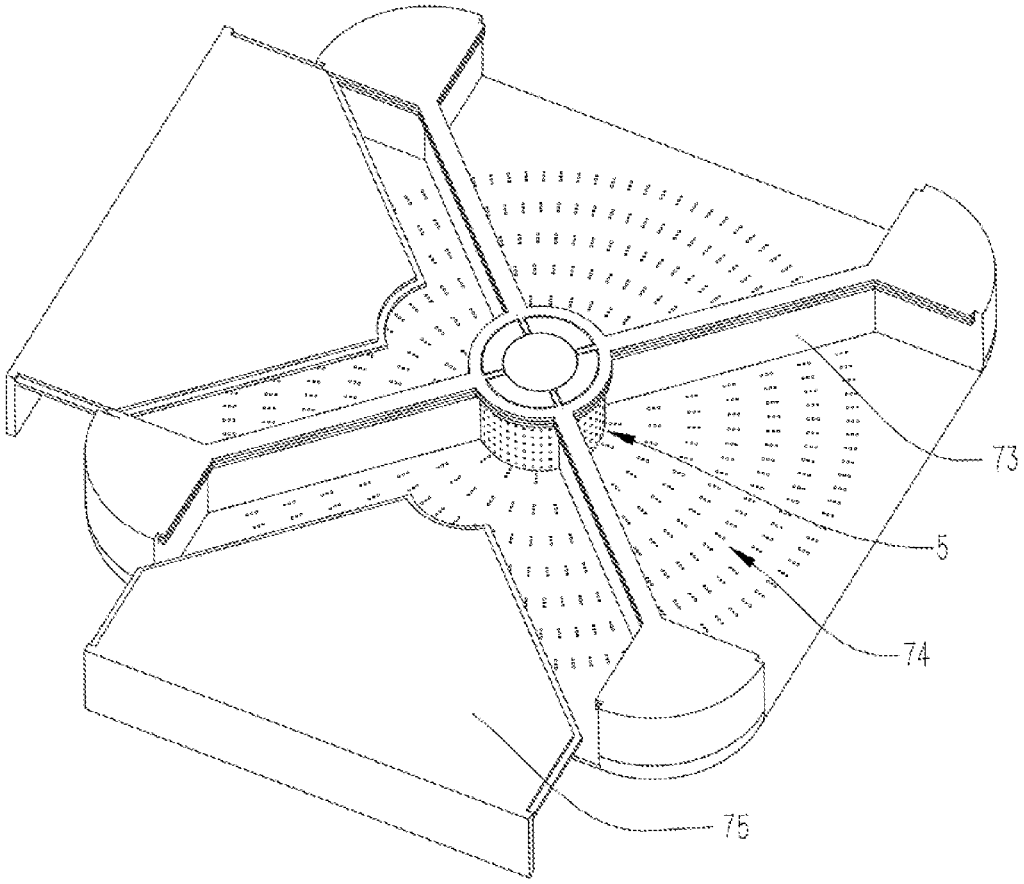
FIG. 11 is a schematic diagram of the back of the inner frame of the disclosure.

Please refer to FIG. 7, the embodiment further includes a heating sheet 6 and/or a cooling sheet arranged between the cover 1 and the soft core 2. The upper and lower sides of the cushion are provided with a cooling sheet or a heating sheet 6 respectively, or one side is provided with a heating sheet 6 and the other side is provided with a cooling sheet. The cooling sheet or the heating sheet 6 can be attached to the inner side of the cover or the outer side of the soft core 2, preferably arranged in a detachable way, such as connecting the two heating sheets into a barrel shape and then inserting them onto the soft core 2. On the one hand, it facilitates to clean of the cushion after disassembly without damaging the cooling sheet or heating sheet, and on the other hand, it is convenient for replacing the cooling sheet or heating sheet in different seasons.

In the embodiment, the power supply unit is a power bank or a battery box removably placed in the inner bag 20; and/or, the power supply unit is the power supply interface 30 arranged on the cover 1. The power bank is also a commonly used tool in daily life, and it is more convenient to place the power bank in the inner bag 20 as a power source. When there is no power bank, it can also be powered by an external power source through the power supply interface 30 on the cover 1.

The embodiment, please refer to FIGS. 7-11, an inner frame 7 is further provided, which is placed in the soft core 2 of the cushion. When implemented the present embodiment, the size of the inner bag of the soft core 2 needs to be made larger. The interior of the inner frame 7 is provided with a cavity, the cavity is provided with the sounder. the cavity is provided with sound holes 701 on the side facing a leaning surface of the cushion, and the bottom of the sound holes 701 penetrate into the cavity of the inner frame 7. The sound direction of the sounder 5 is perpendicular to the direction of the sound hole 701, and the sound of the sounder 5 is vertically emitted from the sound holes 701 after multiple lateral reflections on the side wall of the cavity. The sounder is positioned inside the inner frame, and the produced sound first fills the cavity with resonance. After multiple reflections on the cavity wall, it emits through the sound holes, greatly promoting the efficiency of sound producing, improving sound quality, and enhancing the expressive power of sound color. Especially when using the sounder to play natural white noise such as rain and insect chirping, it creates an ethereal sound effect, creating an immersive feeling.

Furthermore, the top surface of the inner frame 7 is provided with a plurality of annular grooves 70, and the sound holes 701 are arranged inside the annular grooves 70. The top surface of the inner frame 7 is further provided with at least two straight grooves 71 arranged in a "X" shape, and a plurality of the annular grooves 70 are divided into at least four areas by the straight grooves 71, each of which is an independent broadcasting zone 72. The cavity of the inner frame 7 is provided with partition plates 73 that match the position of the straight grooves 71, and the partition plates divide the cavity into broadcasting chambers 74 that match the broadcasting zone 72. The sounder 5 is positioned in the middle of the four broadcasting chambers 74 and plays sound to the four broadcasting chambers 74. Four broadcasting chambers are independently arranged, located in different areas in the cushion, through different areas to play different sound level and sound content, which can be superimposed on a more realistic and rich natural sound, both far and near.

Furthermore, the resilient hollowed members 8 are fixedly arranged in the annular grooves 70, and filled with fluid. In the initial state, the cross-sections of the resilient hollowed members 8 are smaller than that of the annular grooves 70, and the sound holes 701 in the annular grooves 70 are directly communicated with the outside. When the part of resilient hollowed members 8 are compressed, the remaining part expand and tightly fit with the annular grooves 70 to block the corresponding sound holes 701. When the head of the user is resting on a certain area, the resilient hollowed members in that area are compressed, causing the sound holes in that area to be blocked, resulting in a lower and deeper sound in that area. The sound holes in the surrounding area remains open, and the corresponding sound is not affected.

In the embodiment, the cushion further includes a power supply unit and a controller. The fluid inside the resilient hollowed members 8 is a conductive solution, and electrodes 80 are arranged at both ends of the resilient hollowed members 8 and electrically connected to the controller.

When the resilient hollowed members 8 are partially compressed, the conductive cross-sections of the resilient hollowed members 8 change, causing a change in conductivity. The controller is accordingly informed of the pressurized area and the strength of the pressurization, and the sound level and play content of the sounder 5 towards the four broadcasting chambers 74 can be independently controlled. Through the above solution, the controller can determine the specific position of the human body leaned on the cushion, and then play sound with different contents and intensities of into the four broadcasting chambers through the sounder. Combined with the relative positions of the four broadcasting chambers and where the user leans, a scene with more natural and realistic can be simulated. By focusing on the distance of broadcasting, the order of broadcasting in different regions, the volume, and the differences in the content played, people can enter the world rendered by sound, with where to rest as the center.

Furthermore, a luminescent strip 9 attached to the bottom of the annular groove 70, and the circuit of the luminescent strip 9 is connected in series with the circuit of the resilient hollowed members 8, and the brightness of the luminescent strip 9 varies with the degree to which the resilient hollowed members 8 has been compressed. The luminescent strip is attached to the bottom of the annular groove. The light emitted by the luminescent strip first refracts and scatters through the fluid in the resilient hollowed member, and then passes through the soft core to reach the surface of the cushion. At this time, the light is softer, giving a warm feeling. Combined with special sound effects, it is more conducive to relaxing mood. And the brightness intensity can also change according to the position where the user leans, bringing in more spiritual atmosphere.

Furthermore, the bottom of the inner frame 7 is provided with a pull-out plate 75. The pull-out plate 75 can be pulled out to accommodate a temperature control medium 76, and the pull-out plate 75 is pushed in to form sealed broadcasting chambers 74. The temperature control medium 76 is an ice bag or a hot water bag. The sounder 5 and the power supply unit can be detachably arranged on the inner frame 7 and can be taken out for independent use. The temperature control medium can be a hot water bag or an ice bag, which is placed in the inner frame. The hot air or cold air emitted together with the sound through the sound control, creating a warm or cool feeling at where the user leans, combined with the comprehensive effect of sound and light, it makes people feel relaxed and relieved.

As above, the disclosure effectively overcomes various shortcomings in existing technology, can produce advantageous technical effects, and has significant progress.

The above embodiments are only illustrative of the principle and effect of the disclosure, and are not intended to limit the disclosure. Anyone familiar with this technology may modify or change the above embodiments without departing from the spirit and scope of the disclosure. Therefore, all equivalent modifications or changes completed by those with ordinary skilled person in the art without departing from the spirit and technical ideas disclosed in the disclosure should still be covered by the claims of the disclosure.

What is claimed is:

1. A cushion, comprising:

a cover (1), a soft core (2), a power supply unit, a sounder (5), an inner frame (7) and a luminescent strip (4), wherein the cover (1) wraps the soft core (2), the sounder (5) is arranged in the soft core (2), and the luminescent strip (4) is arranged inside a margin edge strip and/or a decorative edge of a side of the cover (1) and powered by the power supply unit;

the inner frame (7) is placed in the soft core (2) of the cushion, an interior of the inner frame (7) is provided with a cavity, the cavity is provided with a sounder (5), the cavity is provided with sound holes (701) on a side facing a leaning surface of the cushion, bottoms of the sound holes (701) penetrate into the cavity of the inner frame (7), a sound direction of the sounder (5) is perpendicular to directions of the sound holes (701), and the sound of the sounder (5) is vertically emitted from the sound holes (701) after multiple lateral reflections on a side wall of the cavity;

a top surface of the inner frame (7) is provided with a plurality of annular grooves (70), and the sound holes (701) are arranged inside the annular grooves (70);

the top surface of the inner frame (7) is further provided with at least two straight grooves (71) arranged in "X" shape, and the plurality of the annular grooves (70) are divided into at least four areas by the straight grooves (71), each area is an independent broadcasting zone (72);

the cavity of the inner frame (7) is provided with partition plates (73) that match positions of the straight grooves (71), the partition plates divide the cavity into broadcasting chambers (74) that match the broadcasting zones (72), and the sounder (5) is positioned in a middle of the four broadcasting chambers (74) and plays sound to the four broadcasting chambers (74).

2. The cushion as claimed in claim 1, wherein the soft core (2) is folded and sewn to form an inner bag (20) in a shape of a pocket, and the sounder (5) is capable of being taken out or placed in the inner bag (20) in a fixed manner.

3. The cushion as claimed in claim 1, wherein the sounder (5) is configured to play white noise, and powered by the power supply unit and/or a built-in battery, the sounder (5) is capable of playing preset content and/or controlling play content through short-range wireless communication.

4. The cushion as claimed in claim 1, wherein the cover (1) is made by sewing fabric, the margin edge strip on the side of the cover (1) is form by sewing a margin zone (10) that left after the fabric is folded in half together, and the luminescent strip (4) is threaded inside the margin zone (10).

5. The cushion as claimed in claim 1, wherein the decorative edge is a fabric bag strip (11) made of fabric, the luminescent strip (4) is threaded into the fabric bag strip (11), and the fabric bag strip is fixedly sewn on the side of the cover or detachably connected to the side of the cover (1).

6. The cushion as claimed in claim 1, further comprising a heating sheet (6) and/or a cooling sheet arranged between the cover (1) and the soft core (2).

7. The cushion as claimed in claim 2, wherein the power supply unit is a power bank or a battery box removably placed in the inner bag (20); and/or, the power supply unit is a power supply interface (30) arranged on the cover (1).

8. The cushion as claimed in claim 1, wherein resilient hollowed members (8) are fixedly arranged in the annular grooves (70) and filled with fluid; in an initial state, cross-sections of the resilient hollowed members (8) are smaller than that of the annular grooves (70), and the sound holes (701) in the annular grooves (70) are directly communicated with an outside; when a part of resilient hollowed members (8) are compressed, a remaining part of resilient hollowed members expand and tightly fit with the annular grooves (70) to block the corresponding sound holes (701).

* * * * *